US005829409A

United States Patent [19]

Saito et al.

[11] Patent Number: 5,829,409

[45] Date of Patent: Nov. 3, 1998

[54] THROTTLE VALVE CONTROL APPARATUS

[75] Inventors: Katsumi Saito, Asaka; Katsunori Aoyagi, Miyagi-ken, both of Japan

[73] Assignee: Hadsys, Inc., Miyagi-ken, Japan

[21] Appl. No.: 842,446

[22] Filed: Apr. 24, 1997

[30] Foreign Application Priority Data

Jan. 20, 1997 [JP] Japan ..... 9-007704

[51] Int. Cl.[6] ..... F02D 9/08

[52] U.S. Cl. ..... 123/396; 123/399; 123/400

[58] Field of Search ..... 123/396, 400, 123/399, 361

[56] References Cited

U.S. PATENT DOCUMENTS

| | | | |
|---|---|---|---|
| 4,785,782 | 11/1988 | Tanaka et al. | 123/399 |
| 4,848,505 | 7/1989 | Yoshizawa et al. | 180/197 |
| 5,131,364 | 7/1992 | Mann | 123/399 |
| 5,265,572 | 11/1993 | Kadomukai et al. | 123/396 |
| 5,297,521 | 3/1994 | Sasaki et al. | 123/396 |
| 5,297,522 | 3/1994 | Buchl | 123/399 |
| 5,367,997 | 11/1994 | Kawamura et al. | 123/399 |
| 5,664,542 | 9/1997 | Kanazawa et al. | 123/361 |
| 5,685,521 | 11/1997 | Yoshida et al. | 251/313 |

FOREIGN PATENT DOCUMENTS

| | | |
|---|---|---|
| 2-91432 | 3/1990 | Japan . |
| 5-248273 | 9/1993 | Japan . |

*Primary Examiner*—Tony M. Argenbright
*Assistant Examiner*—Hieu T. Vo
*Attorney, Agent, or Firm*—Paul A. Guss

[57] ABSTRACT

When an accelerator drum of a throttle valve control apparatus is turned in a valve opening direction to open a throttle valve, an electric motor is energized to turn a rotatable shaft thereof through a predetermined angle, causing a valve shaft to turn the throttle valve in the valve opening direction. The angular movement of the throttle valve is transmitted from a valve shaft lever through a link to an intermediate lever, whose first engaging finger is angularly moved in the valve opening direction relatively to a second engaging finger of the accelerator drum. The throttle valve control apparatus allows the throttle valve to be controlled with an accelerator pedal and the electric motor. The throttle valve control apparatus is relatively simple in structure, can be designed with increased layout freedom, and can perform both a fail-safe function and a limping-home function.

12 Claims, 8 Drawing Sheets

THROTTLE VALVE CONTROL APPARATUS

BACKGROUND OF THE INVENTION

1. Field of the Invention

The present invention relates to a throttle valve control apparatus for controlling the opening and closing movement of a valve shaft on which a throttle valve is mounted through manual operation of an accelerator pedal and electric operation of an electric motor.

2. Description of the Related Art

There has heretofore been known an electronic throttle valve control apparatus for controlling intake valves of an internal combustion engine for use on automobiles or the like. The electronic throttle valve control apparatus electrically detects an amount of depression of an accelerator pedal and energizes an electric motor to open or close the throttle valve depending on the detected amount of depression for bringing the rotational speed of the engine into agreement with a target rotational speed.

The electronic throttle valve control apparatus with the single electric motor is capable of executing a plurality of control modes including a normal running mode, a traction control mode, a cruise control mode, and idling control mode. For the electronic throttle valve control apparatus to carry out such various control modes, it is necessary that the electric motor and the accelerator pedal should not interfere with each other in operating the throttle valve. To meet this requirement, the electronic throttle valve control apparatus necessarily becomes complex in structure. It is desirable for the electronic throttle valve control apparatus to have a fail-safe function which makes itself sufficiently reliable in operation in the event of undesirable malfunctions.

Japanese laid-open patent publication No. 5-248273 discloses a throttle valve control apparatus for an internal combustion engine which provides a fail-safe capability to allow the engine to be controlled with an accelerator pedal even when a throttle valve actuator system fails to function normally.

A throttle valve opening/closing control apparatus disclosed in Japanese laid-open patent publication No. 2-91432 has a mechanical throttle valve compensator for opening or closing or fully closing a throttle valve in the event of a shutdown of an electric throttle valve actuator. The mechanical throttle valve compensator does not interfere with the opening or closing of the throttle valve by the electric throttle valve actuator during its normal operation.

According to the former publication, the throttle valve control apparatus has a single electric motor capable of operation in all control modes, but needs a speed reducer and an electromagnetic clutch, and also two lost-motion springs in association with an accelerator pedal as well as a return spring for a throttle valve shaft. Consequently, the disclosed throttle valve control apparatus is relatively complex in structure.

According to the latter publication, the throttle valve opening/closing control apparatus has an electric motor actuator mechanism and an accelerator pedal actuator mechanism, both positioned on one side of a throttle valve shaft. Therefore, the throttle valve opening/closing control apparatus is also of a relatively complex structure, and suffers layout limitations imposed by the electric motor actuator mechanism and the accelerator pedal actuator mechanism. Such layout limitations reduce design freedom as to various components, e.g., prevent an accelerator opening sensor from being installed on a throttle valve housing.

SUMMARY OF THE INVENTION

It is therefore a general object of the present invention to provide a throttle valve control apparatus which is relatively simple in structure and can be designed with increased freedom.

A major object of the present invention is to provide a throttle valve control apparatus which is capable of controlling the opening and closing movement of a valve shaft on which a throttle valve is mounted through manual operation of an accelerator pedal and electric operation of an electric motor.

Another object of the present invention is to provide a throttle valve control apparatus which permits a valve shaft on which a throttle valve is mounted to be operated by an electric motor regardless of any angular movement of an accelerator drum, for carrying out various control modes including a traction control mode, a cruise control mode, and idling control mode.

Still another object of the present invention is to provide a throttle valve control apparatus for use in an automobile which has a simplified accelerator pedal actuator mechanism that can be positioned in any of various locations for greater layout freedom.

A further object of the present invention is to provide a throttle valve control apparatus for use in an automobile which, when an accelerator pedal is depressed a predetermined depth, opens a throttle valve thereby to enable the automobile to move to a desired position even in the event of a failure of an electric motor actuator mechanism, while preventing the automobile from running at speeds higher than a given speed.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
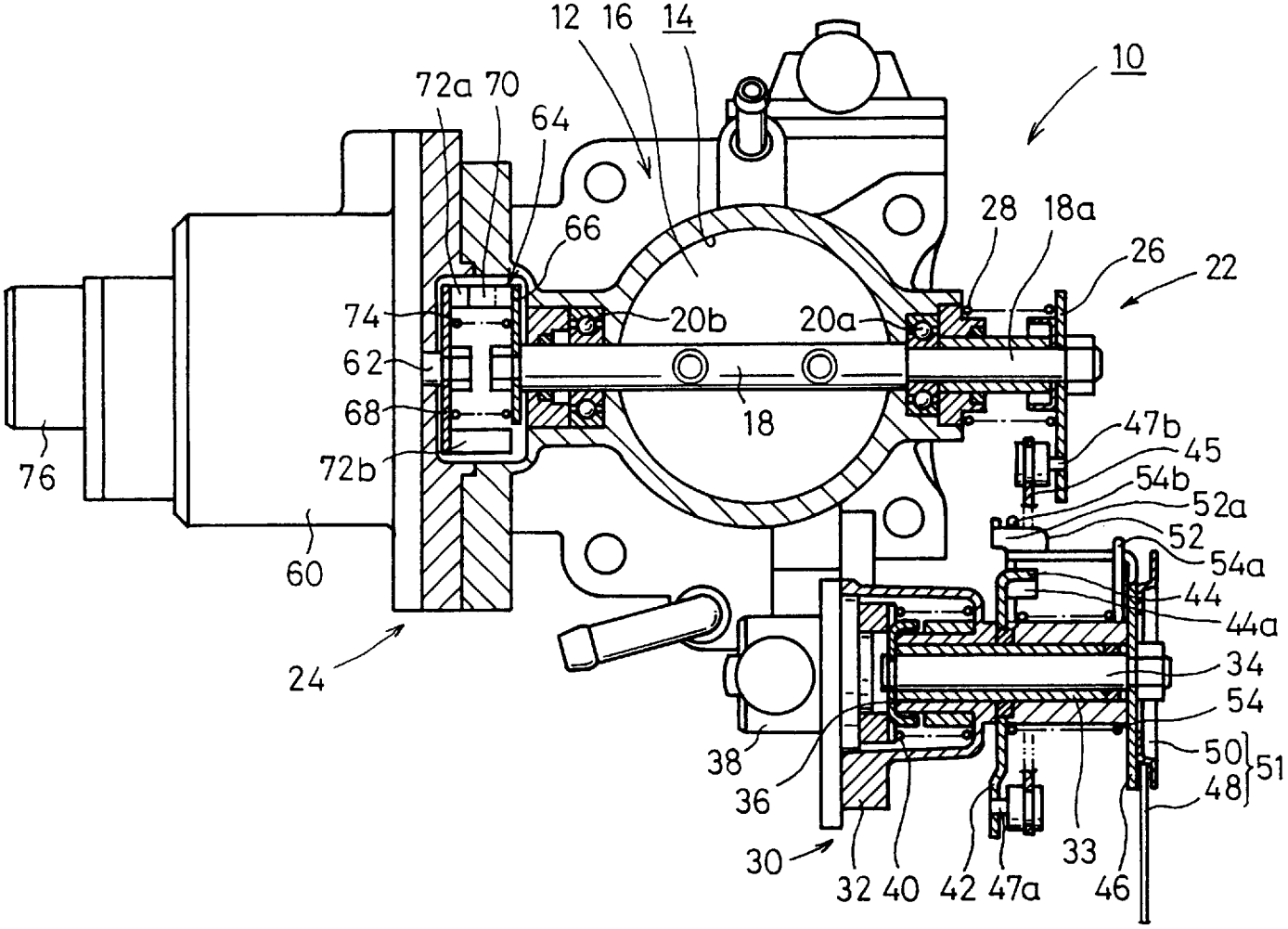
FIG. 1 is a vertical cross-sectional view of a throttle valve control apparatus according to a first embodiment of the present invention.

FIG. 1 shows in vertical cross section a throttle valve control apparatus 10 according to a first embodiment of the present invention. As shown in FIG. 1, the throttle valve control apparatus 10 serves to angularly move a substantially disk-shaped throttle valve 16 to control the opening of an air-fuel mixture passage 14 of circular cross section which is defined in a throttle valve housing 12.

The throttle valve 16 is fixedly mounted on a valve shaft 18 which is angularly movably supported in the throttle valve housing 12 by a pair of ball bearings 20*a*, 20*b* disposed one on each side of the air-fuel mixture passage 14. An accelerator pedal actuator mechanism 22 is positioned at and operatively coupled to one end of the valve shaft 18, and an electric motor actuator mechanism 24 is positioned at and operatively coupled to the opposite end of the valve shaft 18. The accelerator pedal actuator mechanism 22 has a valve shaft lever 26 fixed to an end portion 18*a* of the valve shaft 18 which projects out of the throttle valve housing 12. A return spring 28 for normally urging the valve shaft lever 26 to move in a valve closing direction, i.e., a direction to close the throttle valve 16, is interposed between the valve shaft lever 26 and the throttle valve housing 12.

The accelerator pedal actuator mechanism 22 includes an accelerator pedal sensor 30 which has an accelerator pedal sensor body 32 fixed to the throttle valve housing 12. A tubular member 33 is fixedly mounted on the throttle valve housing 12 and extends from within the throttle valve housing 12 and out of the throttle valve housing 12 parallel to the valve shaft 18. A sensor shaft 34 is angularly movably disposed in the tubular member 33, and an accelerator pedal sensor lever 36 is secured to an end of the sensor shaft 34 which is located in the throttle valve housing 12. The accelerator pedal sensor lever 36 is coupled to an encoder 38 mounted on the accelerator pedal sensor body 32. The encoder 38 converts an angular displacement of the accelerator pedal sensor lever 36 to an electric signal, which is applied to a controller (not shown). An accelerator pedal sensor return spring 40 is interposed between the accelerator pedal sensor lever 36 and the accelerator pedal sensor body 32 for normally biasing the sensor shaft 34 to rotate in the valve closing direction.

An intermediate lever 42 is angularly movably disposed around the tubular member 33 closely to the accelerator pedal sensor body 32. The intermediate lever 42 includes a first engaging finger 44 (see also FIG. 2) extending from an end thereof in the axial direction of the sensor shaft 34. To the opposite end of the intermediate lever 42, there is pivotally coupled by a pin 47*a* an end of an elongate link 45 whose opposite end is pivotally joined to the valve shaft lever 26 by a pin 47*b*. Therefore, the first engaging finger 44 and the valve shaft 18 are angularly movable in unison with each other.

An accelerator drum 46 is fixedly mounted on an end of the sensor shaft 34 which is remote from the accelerator pedal sensor body 32. The accelerator drum 46 has an accelerator wire engaging disk 50 on its axially outer end which engages an end of an accelerator wire 48 that is coupled to an accelerator pedal (not shown). The accelerator wire 48 and the accelerator wire engaging disk 50 jointly serve as an accelerator wire engaging mechanism 51 which operatively interconnects the accelerator drum 46 and the accelerator pedal. The accelerator wire engaging mechanism 51 causes the accelerator drum 46 to angularly move by an angular displacement corresponding to a depth by which the accelerator pedal is depressed by the driver of an automobile which incorporates the throttle valve control apparatus 10.

The accelerator drum 46 also has a second engaging finger 52 extending from an end thereof in the axial direction of the sensor shaft 34. The second engaging finger 52 is positioned radially outwardly of the first engaging finger 44, so that the second engaging finger 52 will angular move along an arcuate path whose radius of curvature is greater than the radius of curvature of an arcuate path along which the first engaging finger 44 angularly moves. A lost-motion spring 54 is disposed axially between the accelerator drum 46 and the intermediate lever 42 radially around the sensor shaft 34. The lost-motion spring 54 has an end 54*a* engaging the second engaging finger 52 for normally urging the second engaging finger 52 in the valve closing direction, and an opposite end 54*b* engaging at least one of the first engaging finger 44 and the second engaging finger 52 for normally urging one or both of the first engaging finger 44 and the second engaging finger 52 in a valve opening direction, i.e., a direction to open the throttle valve 16. The first engaging finger 44 and the second engaging finger 52 have respective flat surface portions 44*a*, 52*a* engageable with the opposite end 54*b* of the lost-motion spring 54.

The electric motor actuator mechanism 24 comprises an electric motor 60 such as a stepping motor mounted on the throttle valve housing 12. The electric motor 60 is controlled for its rotation by the controller (not shown). The electric motor 60 has a rotatable shaft 62 positioned coaxially with the valve shaft 18. The rotatable shaft 62 and the valve shaft 18 are coupled to each other by a motor coupling mechanism 64. The motor coupling mechanism 64 has a first coupling lever 66 fixed to the end of the valve shaft 18 remote from the end portion 18*a* thereof, and a second coupling lever 68 fixed to the rotatable shaft 62. The first coupling lever 66 has an engaging tooth 70 extending from an end thereof in the axial direction of the valve shaft 18, and the second coupling lever 68 has a pair of engaging teeth 72*a*, 72*b*, which are 180° spaced apart from each other, for engagement with the engaging tooth 70. A motor coupling spring 74 is axially interposed between the first coupling lever 66 and the second coupling lever 68, and has opposite ends engaging the engaging teeth 70, 72*b*, respectively, for normally biasing the second coupling lever 68 to turn in the valve opening direction. Therefore, the engaging tooth 72*a* is normally held in engagement with the engaging tooth 70 for angularly moving the rotatable shaft 68 and the valve shaft 18 in unison with each other. The electric motor actuator mechanism 24 also includes an encoder 76 mounted on the electric motor 60 remotely from the valve shaft 18. The encoder 76 converts an angular displacement of the rotatable shaft 62 to an electric signal, which is applied to the non-illustrated controller.

Operation of the throttle valve control apparatus 10 according to the first embodiment of the present invention will be described below.

Figure 2:
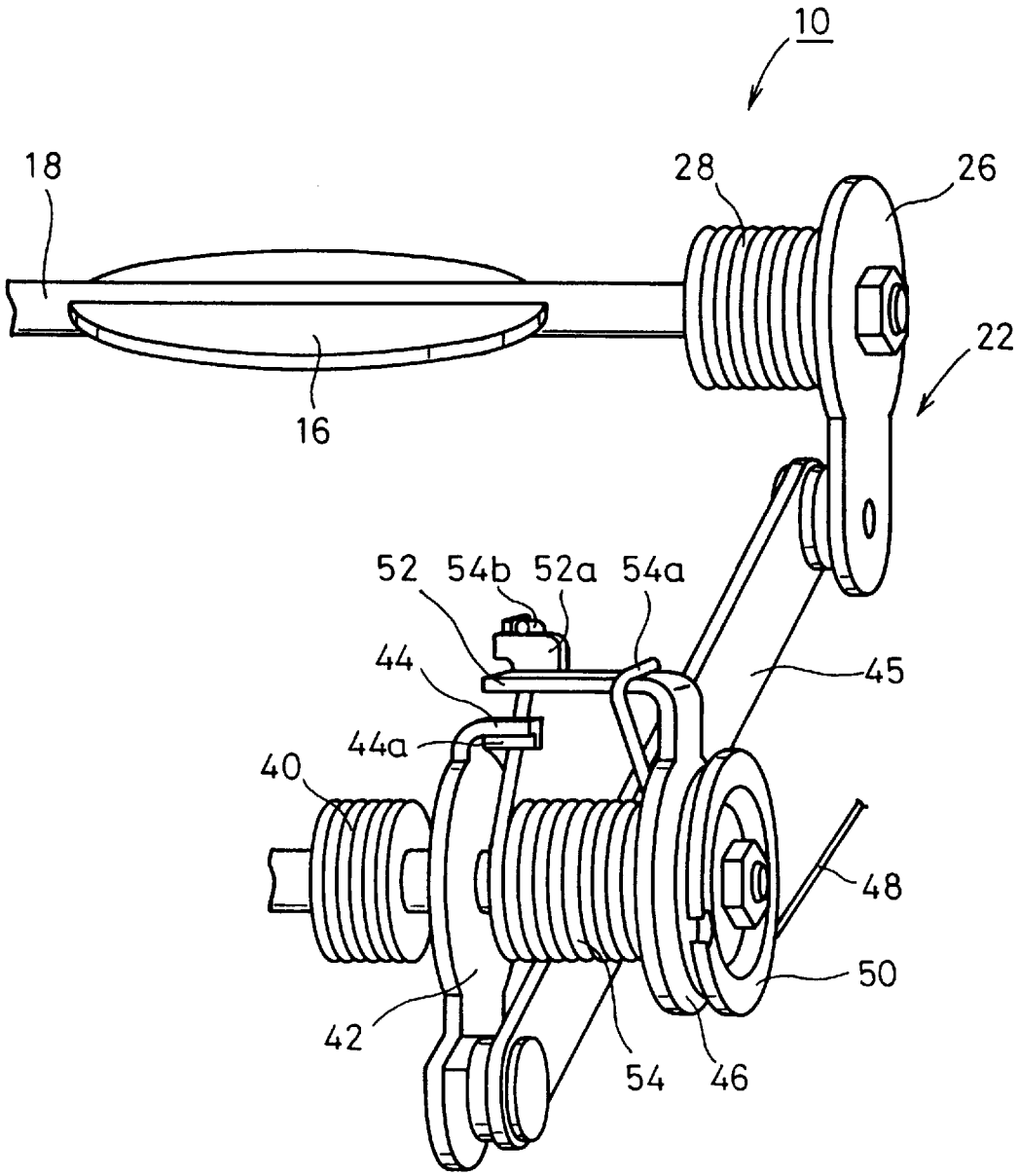
FIG. 2 is a perspective view of certain parts of the throttle valve control apparatus shown in FIG. 1 at the time it closes a throttle valve.

As shown in FIG. 2, when the accelerator pedal actuator mechanism 22 is in its initial state, the ends 54*a*, 54*b* of the lost-motion spring 54 engage the second engaging finger 52 of the accelerator drum 46, and the end 54*b* of the lost-motion spring 54 is substantially held in engagement with, or slightly spaced from, the first engaging finger 44 of the intermediate lever 42. At this time, the valve shaft 18 is biased in the valve closing direction by the return spring 28. In the motor coupling mechanism 64, the engaging tooth 70 of the first coupling lever 66 engages the engaging tooth 72*a* of the second coupling lever 68 (see FIG. 1). The rotatable shaft 62 of the electric motor 60 angularly moves to a given position, i.e., a position to turn the throttle valve 16 to a predetermined minimum idling position.

Figure 3:
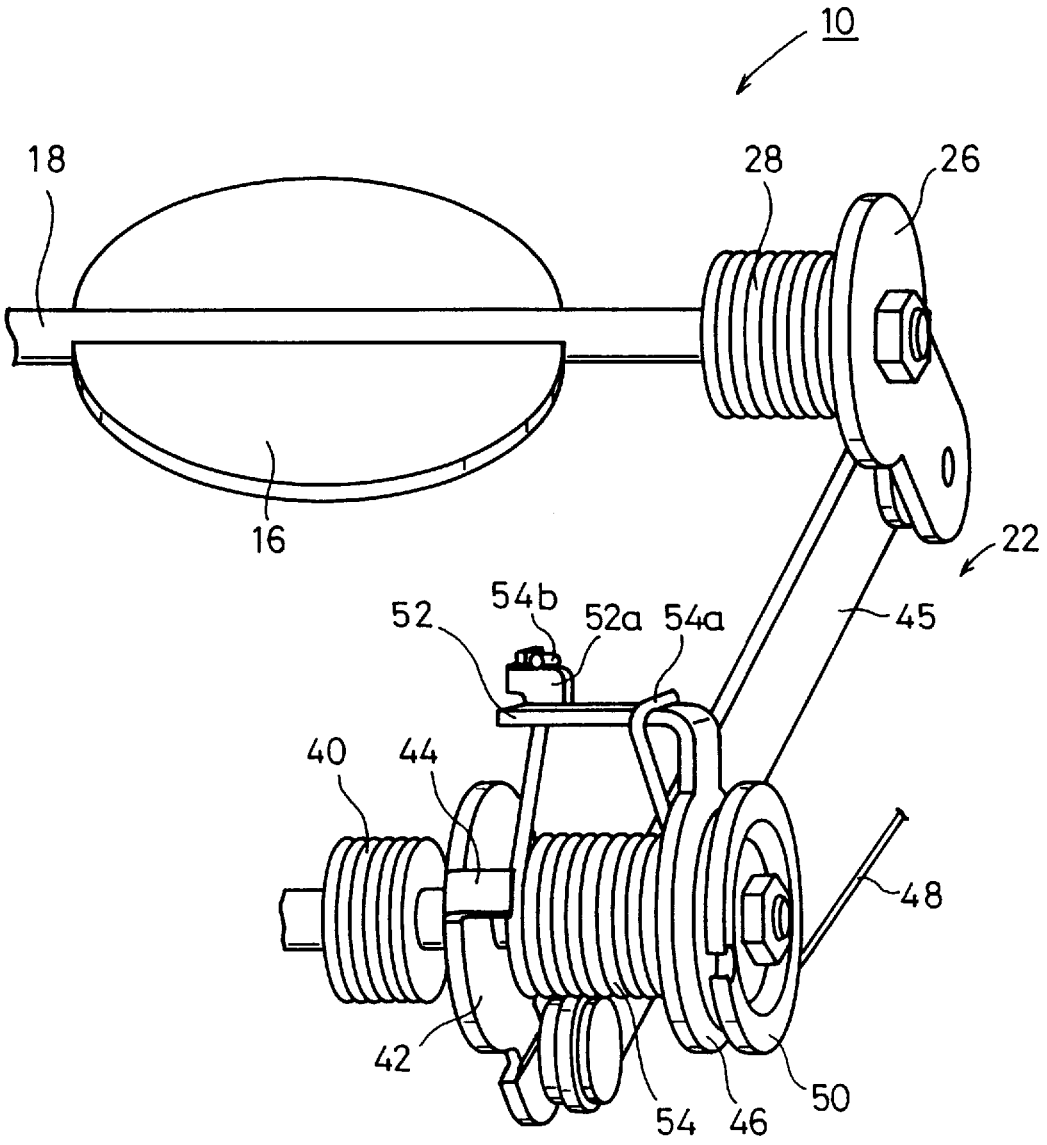
FIG. 3 is a perspective view of certain parts of the throttle valve control apparatus shown in FIG. 1 at the time it operates in a cruise control mode.

When the non-illustrated accelerator pedal is depressed by the driver, the accelerator wire 48 is pulled, angularly moving the accelerator drum 46 in the valve opening direction. The encoder 38 of the accelerator pedal sensor 30 now outputs an electric signal commensurate with the angular displacement of the accelerator drum 46 to the controller, which energizes the electric motor 60 to turn the rotatable shaft 62 thereof through a corresponding angle. The engaging tooth 72*a* of the second coupling lever 68 pushes the engaging tooth 70 of the first coupling lever 66, angularly moving the throttle valve 16 in the valve opening direction, as shown in FIG. 3. The angular movement of the throttle valve 16 is transmitted from the valve shaft lever 26 through the link 45 to the intermediate lever 42, turning the first engaging finger 44 in the valve opening direction.

Figure 5:
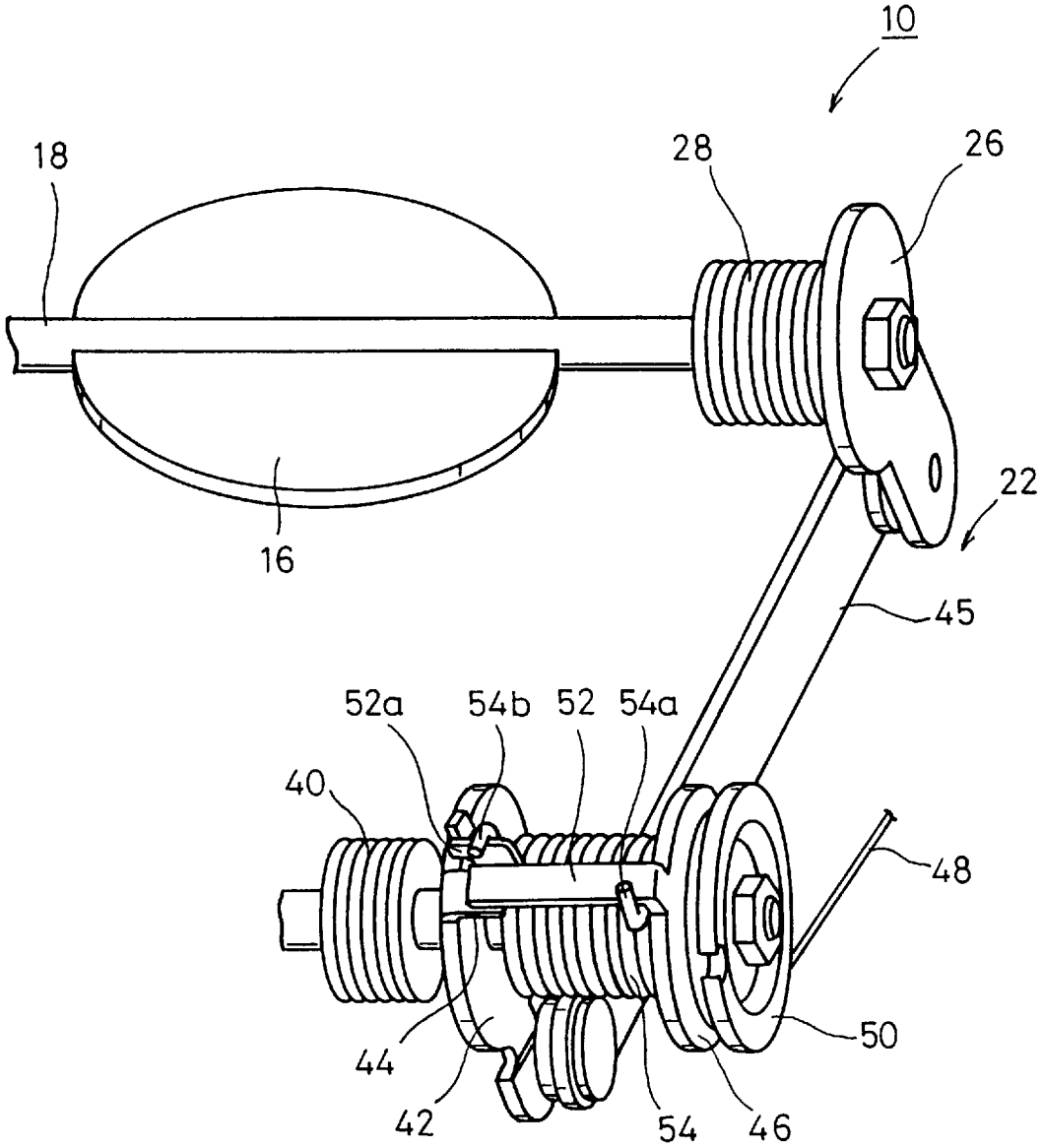
FIG. 5 is a perspective view of certain parts of the throttle valve control apparatus shown in FIG. 1 at the time an accelerator pedal is depressed.

A setting for the opening of the throttle valve 16 with respect to the amount of depression of the accelerator pedal has been established by the controller. If the setting is such that the throttle valve 16 is largely opened even if the amount of depression of the accelerator pedal is small, then the first engaging finger 44 is angularly displaced in the valve opening direction relatively to the second engaging finger 52 and spaced away from the end 54*b* of the lost-motion spring 54. If the setting is such that the throttle valve 16 is opened to a small degree even if the amount of depression of the accelerator pedal is large, then the first engaging finger 44 is angularly displaced in the valve closing direction relatively to the second engaging finger 52 and the end 54*b* of the lost-motion spring 54 engages the first engaging finger 44 and is spaced away from the second engaging finger 52. The setting may be established such that the first engaging finger 44 and the second engaging finger 52 may angularly move in substantial unison with each other, as shown in FIG. 5.

Figure 4:
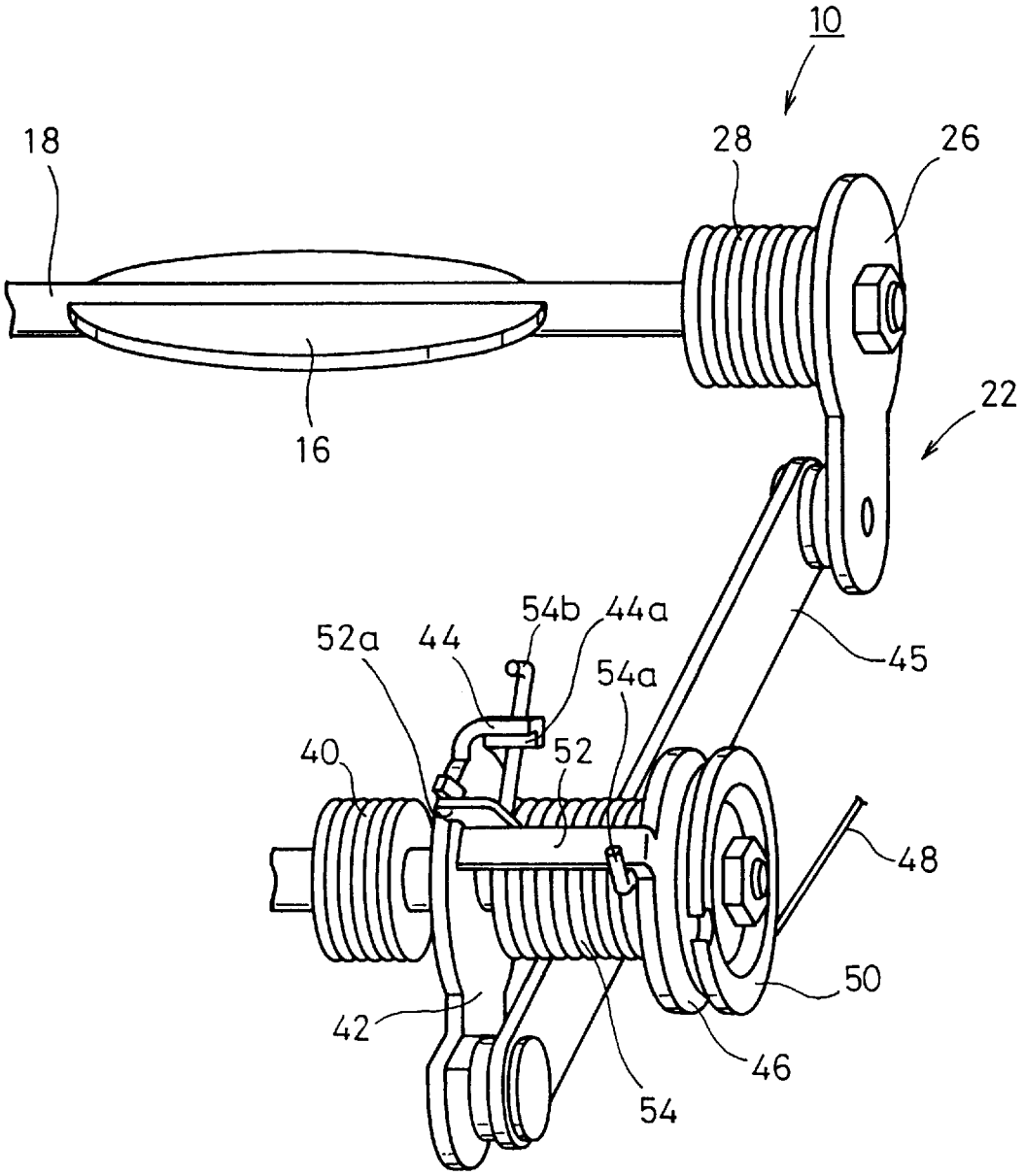
FIG. 4 is a perspective view of certain parts of the throttle valve control apparatus shown in FIG. 1 at the time it operates in a traction control mode.

Because the setting for the opening of the throttle valve 16 with respect to the amount of depression of the accelerator pedal can freely be established as described above, the throttle valve control apparatus 10 is capable of operating in various control modes depending on running conditions of the automobile. For example, in a cruise control mode, the throttle valve 16 is kept at a predetermined degree of opening by the electric motor 60 even if the amount of depression of the accelerator pedal, and the first engaging finger 44 is angularly displaced in the valve opening direction relatively to the second engaging finger 52 (see FIG. 3). If a wheel slipping condition is detected when the throttle valve 16 is kept open, then the throttle valve control apparatus 10 starts a traction control mode. Specifically, the rotatable shaft 62 of the electric motor 60 is turned in the valve closing direction, turning the throttle valve 16 in the valve closing direction (see FIG. 1). The angular movement of the throttle valve 16 is transmitted from the valve shaft lever 26 through the link 45 to the intermediate lever 42, causing the first engaging finger 44 to engage the end 54*b* of the lost-motion spring 54 and turn in the valve closing direction relatively to the second engaging finger 52 (see FIG. 4).

In an idling control mode, the throttle valve 16 is angularly displaced to the predetermined minimum idling position as shown in FIG. 2. At this time, the throttle valve 16 is slightly open, and the control of the throttle valve 16 by the electric motor 60 is not required normally in the idling control mode, except when the engine is started in a cold weather or an air-conditioning unit in the automobile is turned on, at which time the electric motor 60 is energized to increase the opening of the throttle valve 16.

It is possible to establish a setting such that the opening of the throttle valve 16 is eliminated when the valve shaft 18 is turned in the valve closing direction, and the electric motor 60 is energized to open the throttle valve 16 to a desired degree in the idling control mode.

When the electric motor actuator mechanism 24 or the controller for controlling the electric motor actuator mechanism 24 fails to operate due to a malfunction, the electric motor 60 is de-energized. The electric motor 60 does not impose any substantial load, and the rotatable shaft 62 thereof is made freely rotatable. Since the engaging tooth 70 and the engaging tooth 72*a* are held in engagement with each other under the bias of the motor coupling spring 74, the rotatable shaft 62 angularly moves in unison with the valve shaft 18 when the valve shaft 18 angularly moves. Since the rotatable shaft 62 does not impose any substantial load on the valve shaft 18, the valve shaft 18 can easily be angularly moved by the accelerator pedal.

When the accelerator pedal is depressed, the accelerator drum 46 is turned by the accelerator wire 48 as shown in FIG. 5. The end 54*a* of the lost-motion spring 54 is pushed by the second engaging finger 52, and the end 54*b* thereof pushes the first engaging finger 44 in the valve opening direction. Inasmuch as the valve shaft 18 is easily angularly movable at this time, the angular movement of the end 54*b* angularly moves the intermediate lever 42 which causes the link 45 and the valve shaft lever 26 to turn the valve shaft 18 for thereby opening the throttle valve 16. Therefore, even though the electric motor 60 is de-energized, the throttle valve 16 can smoothly be operated in its full range of valve positions from a fully closed position to a fully open position by the accelerator pedal actuator mechanism 22.

Since the throttle valve 16 can be controlled in its opening by the electric motor 60 independently of the depression of the accelerator pedal, the throttle valve control apparatus 10 is capable of operating in the various control modes including the traction control mode, the cruise control mode, and the idling control mode.

The radius of curvature of the arcuate path for the first engaging finger 44 is smaller than the radius of curvature of the arcuate path for the second engaging finger 52. Therefore, the first engaging finger 44 and the second engaging finger 52 are kept out of interfering engagement with each other, and any angular movement of the accelerator drum 46 is impaired. Therefore, the throttle valve 16*b* can be controlled with greater freedom so as to be opened. The lost-motion spring 54 can be reduced in size, and hence the throttle valve control apparatus 10 can also be reduced in size.

Even if the electric motor 60 is de-energized in the event of a failure of the electric motor actuator mechanism 24 or the controller for controlling the electric motor actuator mechanism 24, when the accelerator pedal is depressed, the valve shaft 18 is turned by the accelerator drum 46 through the lost-motion spring 54 for opening the throttle valve 16. Consequently, the automobile can be driven with greater safety to a desired location. At this time, the driver does not feel uneasy and anxious because the feel which the driver has in operating the accelerator pedal does not change abruptly. The throttle valve control apparatus 10 according to the first embodiment, therefore, provides a fail-safe function and a limping-home function.

A throttle valve control apparatus 100 according to a second embodiment of the present invention will be described below with reference to FIG. 6. Those parts of the throttle valve control apparatus 100 which are identical to those of the throttle valve control apparatus 10 are denoted by identical reference numerals and representations, and will not be described in detail.

Figure 6:
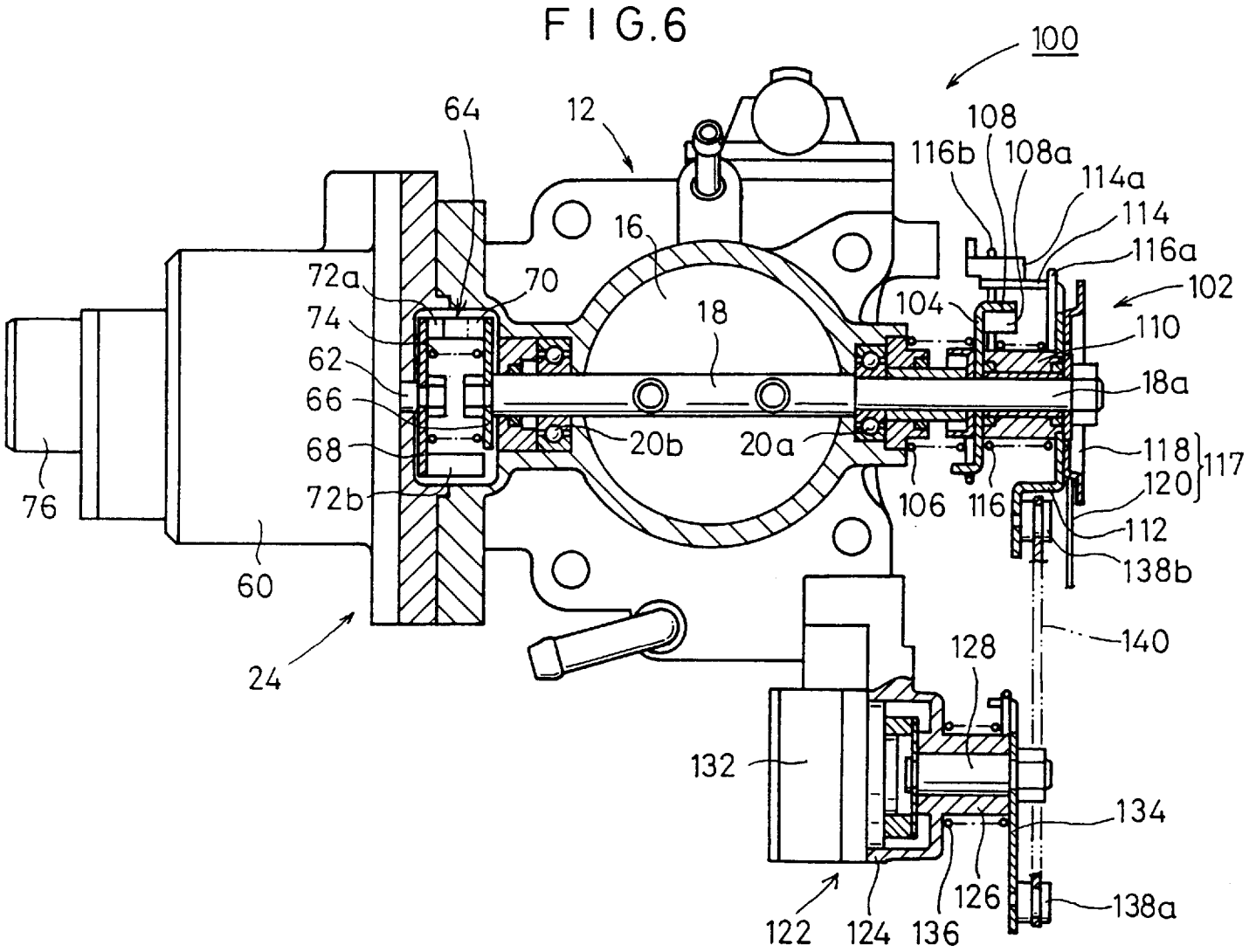
FIG. 6 is a vertical cross-sectional view of a throttle valve control apparatus according to a second embodiment of the present invention.

As shown in FIG. 6, the throttle valve control apparatus 100 has an accelerator pedal actuator mechanism 102 including a valve shaft lever 104 fixed to the end portion 18*a* of the valve shaft 18. A return spring 106 is interposed between the valve shaft lever 104 and the throttle valve housing 12 for normally urging the valve shaft lever 104 to move in the valve closing direction. The valve shaft lever 104 includes a first engaging finger 108 extending from an end thereof in the axial direction of the valve shaft 18. The first engaging finger 108 has a flat surface portion 108*a*. An accelerator drum 112 is angularly movably mounted on the valve shaft 18 axially outwardly of the valve shaft lever 104 with a spacer 110 interposed therebetween. The accelerator drum 112 has a second engaging finger 114 extending from an end thereof in the axial direction of the valve shaft 18. The second engaging finger 114 has a flat surface portion 114*a*.

A lost-motion spring 116 is disposed axially between the valve shaft lever 104 and the accelerator drum 112 radially around the spacer 110. The lost-motion spring 116 has an end 116*a* engaging the second engaging finger 114 for normally urging the second engaging finger 114 in the valve closing direction, and an opposite end 116*b* engaging at lest one of the flat surface portions 108*a*, 114*a* of the first and second engaging fingers 108, 114 for normally urging one or both of the first and second engaging fingers 108 114 in the valve opening direction. The accelerator drum 112 is combined with an accelerator wire engaging mechanism 117 which comprises an accelerator wire engaging disk 118 on the accelerator drum 112 and an accelerator wire 120 connected to the accelerator wire engaging disk 118. The accelerator wire 120 is connected to an accelerator pedal (not shown). The accelerator drum 112 and the accelerator pedal are coupled to each other by the accelerator wire 120 and the accelerator wire engaging disk 118.

The accelerator pedal actuator mechanism 102 includes an accelerator pedal sensor 122 which has an accelerator pedal sensor body 124 fixed to the throttle valve housing 12. The accelerator pedal sensor body 124 has a tubular member 126 extending parallel to the valve shaft 18. A sensor shaft 128 is angularly movably disposed in the tubular member 126, and is coupled to an encoder 132 mounted on the accelerator pedal sensor body 124. The encoder 132 converts an angular displacement of the sensor shaft 128 to an electric signal, which is applied to a controller (not shown). An accelerator pedal sensor lever 134 is fixed to an outer end of the sensor shaft 128, and an accelerator pedal sensor return spring 136 is interposed between the accelerator pedal sensor lever 134 and the accelerator pedal sensor body 124 for normally biasing the accelerator pedal sensor lever 134 to rotate in the valve closing direction. A link 140 has an end pivotally coupled to the accelerator pedal sensor lever 134 by a pin 138*a*, and an opposite end pivotally coupled to the accelerator drum 112 by a pin 138*b*. Thus, the accelerator drum 112 and the accelerator pedal sensor lever 134 are angularly movable in unison with each other.

The throttle valve control apparatus 100 operates as follows:

When the accelerator pedal actuator mechanism 102 is in its initial state, the ends 116*a*, 116*b* of the lost-motion spring 116 engage the second engaging finger 114 of the accelerator drum 112, and the end 116*b* of the lost-motion spring 116 is substantially held in engagement with, or slightly spaced from, the first engaging finger 108 of the valve shaft lever 104.

When the non-illustrated accelerator pedal is depressed by the driver, the accelerator wire 120 is pulled, angularly moving the accelerator drum 112 in the valve opening direction. The angular movement of the accelerator drum 112 is transmitted through the link 140 to the accelerator pedal sensor lever 134. The encoder 132 now outputs an electric signal commensurate with the angular displacement of the sensor shaft 128 to the controller, which energizes the electric motor 60 to turn the rotatable shaft 62 thereof through a corresponding angle. The throttle valve 16 is angularly moved in the valve opening direction by the valve shaft 18. The angular movement of the throttle valve 16 is transmitted to the valve shaft lever 104, turning the first engaging finger 108 in the valve opening direction.

If the angular displacement of the valve shaft 18 by the electric motor 60 is greater than the angular displacement of the accelerator drum 112, then the first engaging finger 108 is angularly displaced in the valve opening direction relatively to the second engaging finger 114 and spaced away from the end 116*b* of the lost-motion spring 116. If the angular displacement of the valve shaft 18 by the electric motor 60 is smaller than the angular displacement of the accelerator drum 112, then the first engaging finger 108 is angularly displaced in the valve closing direction relatively to the second engaging finger 114 and the end 116*b* of the lost-motion spring 116 engages the first engaging finger 108 and is spaced away from the second engaging finger 114. Since the valve shaft 18 can be turned through a desired angle by the electric motor 60 regardless of the angular displacement of the accelerator drum 112, the throttle valve control apparatus 100 is capable of operating in various control modes including a traction control mode, a cruise control mode, and idling control mode, as with the throttle valve control apparatus 10.

When the electric motor actuator mechanism 24 or the controller for controlling the electric motor actuator mechanism 24 fails to operate due to a malfunction, the electric motor 60 is de-energized. The electric motor 60 does not impose any substantial load, and the rotatable shaft 62 turns in the valve closing direction in unison with the valve shaft 18 under the bias of the return spring 106 and the motor coupling spring 74. When the accelerator pedal is depressed, the accelerator drum 112 is turned by the accelerator wire 120. The end 116*a* of the lost-motion spring 116 is turned by the second engaging finger 114, and the end 116*b* thereof presses the first engaging finger 108 in the valve opening direction. At this time, since the rotatable shaft 62 does not impose any substantial load on the valve shaft 18, the valve shaft 18 can easily be angularly moved by the accelerator pedal. Therefore, the valve shaft lever 104 is turned by the angular movement of the end 116*b* of the lost-motion spring 116, turning the valve shaft 18 thereby to open the throttle valve 16. Therefore, even though the electric motor 60 is de-energized, the automobile can continuously be driven by the accelerator pedal actuator mechanism 102.

In the throttle valve control apparatus 100 according to the second embodiment, unlike the throttle valve control apparatus 10 according to the first embodiment, the valve shaft lever 104 having the first engaging finger 108 and the accelerator drum 112 operatively coupled to the accelerator pedal and having the second engaging finger 114 are disposed coaxially with the valve shaft 18. The parts of the throttle valve control apparatus 100 may be positioned in any of various combinations of locations, suffer reduced limitations on their positions, and can be designed with increased layout freedom.

A throttle valve control apparatus 200 according to a third embodiment of the present invention will be described below with reference to FIG. 7. Those parts of the throttle valve control apparatus 200 which are identical to those of the throttle valve control apparatus 10 are denoted by identical reference numerals and representations, and will not be described in detail.

Figure 7:
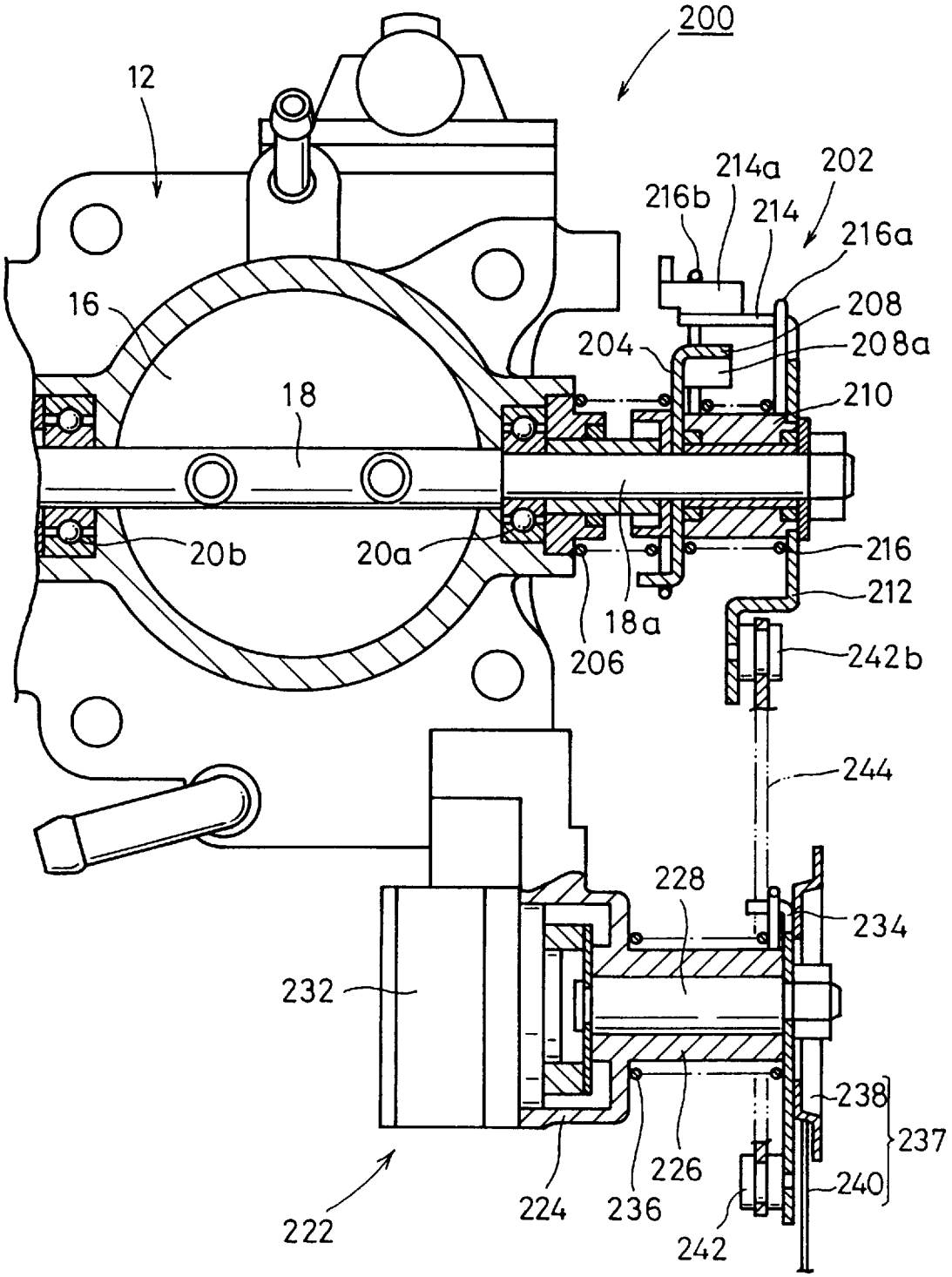
FIG. 7 is a vertical cross-sectional view of a throttle valve control apparatus according to a third embodiment of the present invention.

As shown in FIG. 7, the throttle valve control apparatus 200 has an accelerator pedal actuator mechanism 202 including a valve shaft lever 204 fixed to the end portion 18*a* of the valve shaft 18. A return spring 206 is interposed between the valve shaft lever 204 and the throttle valve housing 12 for normally urging the valve shaft lever 204 to move in the valve closing direction. The valve shaft lever 204 includes a first engaging finger 208 extending from an end thereof in the axial direction of the valve shaft 18. The first engaging finger 208 has a flat surface portion 208*a*. A lost-motion lever 212 is angularly movably mounted on the valve shaft 18 axially outwardly of the valve shaft lever 204 with a spacer 210 interposed therebetween. The lost-motion lever 212 has a second engaging finger 214 extending from an end thereof in the axial direction of the valve shaft 18. The second engaging finger 214 has a flat surface portion 214*a*. A lost-motion spring 216 is disposed axially between the valve shaft lever 204 and the lost-motion lever 212 radially around the spacer 210. The lost-motion spring 216 has an end 216*a* engaging the second engaging finger 214 for normally urging the second engaging finger 214 in the valve closing direction, and an opposite end 216*b* engaging at least one of the flat surface portions 208*a*, 214*a* of the first and second engaging fingers 208, 214 for normally urging one or both of the first and second engaging fingers 208 214 in the valve opening direction.

The accelerator pedal actuator mechanism 202 includes an accelerator pedal sensor 222 which has an accelerator pedal sensor body 224 fixed to the throttle valve housing 12. The accelerator pedal sensor body 224 has a tubular member 226 extending parallel to the valve shaft 18. A sensor shaft 228 is angularly movably disposed in the tubular member 226, and is coupled to an encoder 232 mounted on the accelerator pedal sensor body 224. The encoder 232 converts an angular displacement of the sensor shaft 228 to an electric signal, which is applied to a controller (not shown). An accelerator drum 234 is fixed to an outer end of the sensor shaft 228, and an accelerator pedal sensor return spring 236 is interposed between the accelerator drum 234 and the accelerator pedal sensor body 224 for normally biasing the accelerator drum 234 to rotate in the valve closing direction. The accelerator drum 234 is combined with an accelerator wire engaging mechanism 237 which comprises an accelerator wire engaging disk 238 on the accelerator drum 234 and an accelerator wire 240 connected to the accelerator wire engaging disk 238. The accelerator wire 240 is connected to an accelerator pedal (not shown). The accelerator drum 234 and the accelerator pedal are coupled to each other by the accelerator wire 240 and the accelerator wire engaging disk 238. A link 244 has an end pivotally coupled to the accelerator drum 234 by a pin 242*a*, and an opposite end pivotally coupled to the lost-motion lever 212 by a pin 242*b*. Thus, the lost-motion lever 212 and the accelerator drum 234 are angularly movable in unison with each other.

The throttle valve control apparatus 200 operates as described below.

When the accelerator pedal actuator mechanism 202 is in its initial state, the ends 216*a*, 216*b* of the lost-motion spring 216 engage the second engaging finger 214 of the lost-motion lever 212, and the end 216*b* of the lost-motion spring 216 is substantially held in engagement with, or slightly spaced from, the first engaging finger 208 of the valve shaft lever 204.

When the non-illustrated accelerator pedal is depressed by the driver, the accelerator wire 240 is pulled, angularly moving the accelerator drum 234 in the valve opening direction. The sensor shaft 228 is also angularly moved, and the encoder 232 now outputs an electric signal commensurate with the angular displacement of the sensor shaft 128 to the controller, which energizes the electric motor (not shown in FIG. 7) to turn the throttle valve 16 in the valve opening direction. The angular movement of the throttle valve 16 is transmitted to the valve shaft lever 204, turning the first engaging finger 208 in the valve opening direction.

The angular movement of the accelerator drum 234 is transmitted through the link 244 to the lost-motion lever 212, turning the lost-motion lever 212. If the angular displacement of the valve shaft 18 by the electric motor is greater than the angular displacement of the lost-motion lever 212, then the first engaging finger 208 is angularly displaced in the valve opening direction relatively to the second engaging finger 214 and spaced away from the end 216*b* of the lost-motion spring 216. If the angular displacement of the valve shaft 18 by the electric motor is smaller than the angular displacement of the lost-motion lever 212, then the first engaging finger 208 is angularly displaced in the valve closing direction relatively to the second engaging finger 214 and the end 216*b* of the lost-motion spring 216 engages the first engaging finger 208 and is spaced away from the second engaging finger 214. Since the valve shaft 18 can be turned through a desired angle by the electric motor regardless of the angular displacement of the lost-motion lever 212, the throttle valve control apparatus 200 is capable of operating in various control modes including a traction control mode, a cruise control mode, and idling control mode, as with the throttle valve control apparatus 10, 100.

When the electric motor actuator mechanism or the controller for controlling the electric motor actuator mechanism fails to operate due to a malfunction, the electric motor is de-energized. When the accelerator pedal is depressed, the accelerator drum 234 is turned by the accelerator wire 240, causing the link 244 to turn the lost-motion lever 212. The end 216*a* of the lost-motion spring 216 is turned by the second engaging finger 214, and the end 216*b* thereof presses the first engaging finger 208 in the valve opening direction. At this time, since any load imposed on the valve shaft 18 by the rotatable shaft 62 is small, the valve shaft 18 can easily be angularly moved by the accelerator pedal. Therefore, the valve shaft lever 204 is turned by the angular movement of the end 216*b* of the lost-motion spring 216, turning the valve shaft 18 thereby to open the throttle valve 16. Therefore, even though the electric motor is de-energized, the automobile can continuously be driven by the accelerator pedal actuator mechanism 202.

In the throttle valve control apparatus 200 according to the third embodiment, unlike the throttle valve control apparatus 10, 100 according to the first and second embodiments, the accelerator drum 112 operatively coupled to the accelerator pedal is mounted on the accelerator pedal sensor body 224, and the valve shaft lever 204 having the first engaging finger 208 and the lost-motion lever 212 having the second engaging finger 214 are disposed coaxially with the valve shaft 18. The parts of the throttle valve control apparatus 200 may be positioned in any of various combinations of locations, suffer reduced limitations on their positions, and can be designed with increased layout freedom.

A throttle valve control apparatus 300 according to a fourth embodiment of the present invention will be described below with reference to FIG. 8. Those parts of the throttle valve control apparatus 300 which are identical to those of the throttle valve control apparatus 200 shown in FIG. 7 are denoted by identical reference numerals and representations, and will not be described in detail. The throttle valve control apparatus 300 differs from the throttle valve control apparatus 200 as to the structure of an accelerator drum.

Figure 8:
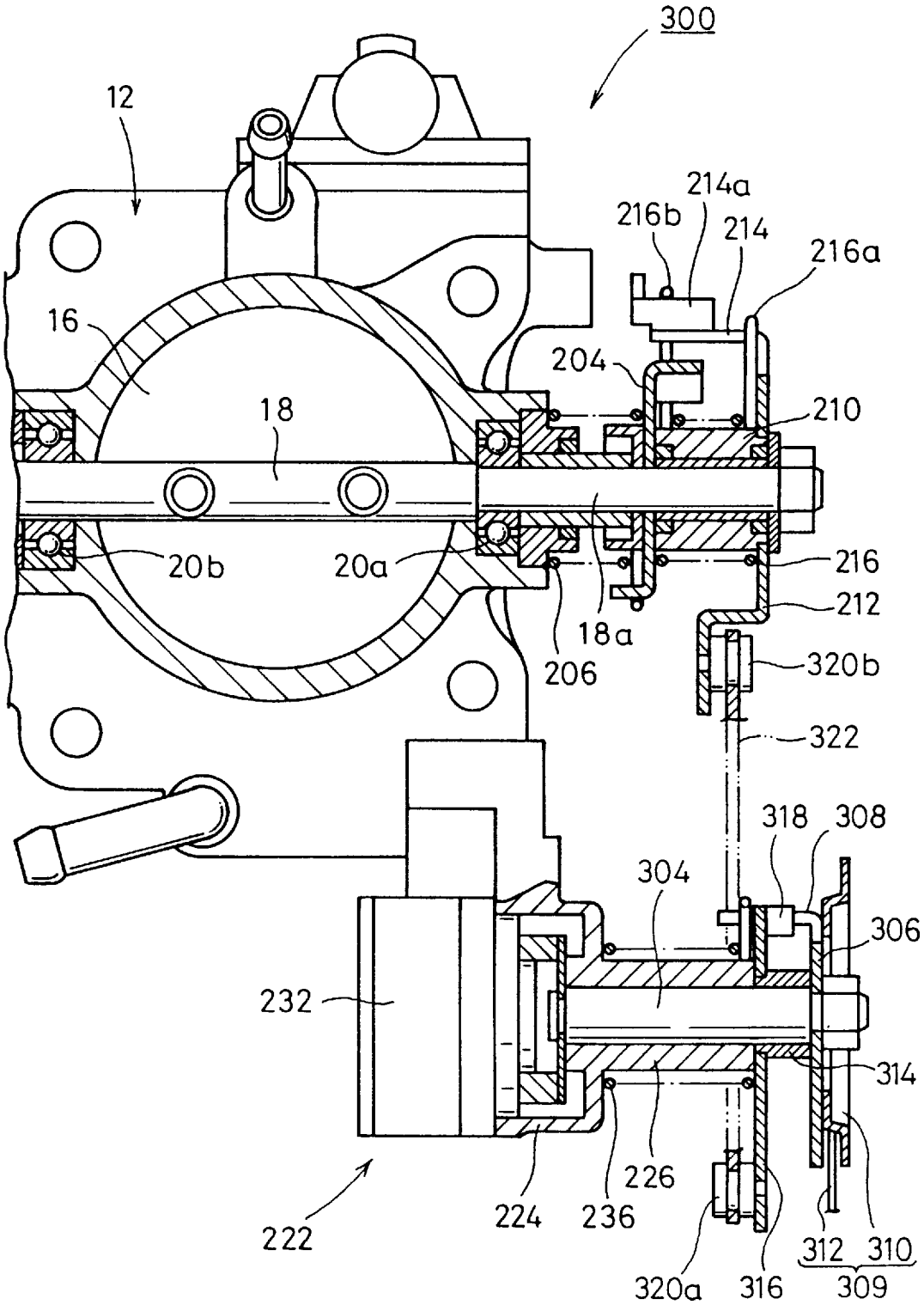
FIG. 8 is a vertical cross-sectional view of a throttle valve control apparatus according to a fourth embodiment of the present invention.

As shown in FIG. 8, the throttle valve control apparatus 300 includes an accelerator pedal sensor 222 having a sensor shaft 304 to which an accelerator drum 306 is fixed. The accelerator drum 306 has an engaging finger 308 engaged by an end of an accelerator pedal sensor return spring 236 for normally biasing the accelerator drum 306 in the valve closing direction. The accelerator drum 306 is combined with an accelerator wire engaging mechanism 309 which comprises an accelerator wire engaging disk 310 on the accelerator drum 306 and an accelerator wire 312 connected to the accelerator wire engaging disk 310. The accelerator wire 312 is connected to an accelerator pedal (not shown). The accelerator drum 306 and the accelerator pedal are coupled to each other by the accelerator wire 312 and the accelerator wire engaging disk 310.

An intermediate lever 316 is angularly movably disposed on a spacer 314 around the sensor shaft 304 axially between the accelerator drum 306 and the tubular member 226. The intermediate lever 316 has an engaging finger 318 engageable with the engaging finger 308. A link 322 has an end pivotally coupled to the intermediate lever 316 by a pin 320*a*, and an opposite end pivotally coupled to the lost-motion lever 212 by a pin 320*b*. Thus, the lost-motion lever 212 and the intermediate lever 316 are angularly movable in unison with each other.

When the throttle valve 16 is in a minimum idling position and the accelerator drum 306 is turned in the valve closing direction, the engaging finger 318 of the intermediate lever 316 is angularly spaced a given angle in the valve opening direction relatively to the engaging finger 308 of the accelerator drum 306. Therefore, when the accelerator drum 306 is angularly moved through an angle less than a predetermined angle, the intermediate lever 316 does not angularly move regardless of the angular movement of the accelerator drum 306. When the accelerator drum 306 is angularly moved through an angle equal to or greater than the predetermined angle, the engaging fingers 308, 318 engage each other, causing the intermediate lever 316 to turn in unison with the accelerator drum 306.

Operation of the throttle valve control apparatus 300 according to the fourth embodiment will be described below. For controlling the opening of the throttle valve 16 with the non-illustrated electric motor, the throttle valve control apparatus 300 operates in the same manner as the throttle valve control apparatus 200. Therefore, such operation of the throttle valve control apparatus 300 will not be described below.

When the electric motor actuator mechanism or the controller for controlling the electric motor actuator mechanism fails to operate due to a malfunction, the electric motor (not shown) is de-energized as with the throttle valve control apparatus 10, 100, 200. The valve shaft 18 is turned in the valve closing direction by the return spring 206 through the valve shaft lever 204, turning the throttle valve 16 to a minimum idling position. When the accelerator pedal is depressed, the accelerator drum 306 is turned by the accelerator wire 312. Insofar as the accelerator drum 306 is turned through an angle less than the predetermined angle, since the engaging fingers 308, 318 are spaced from each other, the intermediate lever 316 is not turned, and the throttle valve 16 is not opened. Consequently, the throttle valve 16 remains in the minimum idling position. When the accelerator pedal is further depressed, turning the accelerator drum 306 through an angle equal to or greater than the predetermined angle, the engaging fingers 308, 318 engage each other, causing the intermediate lever 316 to turn in unison with the accelerator drum 306. The lost-motion lever 212 is turned through the link 322, enabling the lost-motion spring 216 to turn the valve shaft lever 204 thereby to open the throttle valve 16.

According to the fourth embodiment, because the throttle valve 16 is opened when the accelerator pedal is depressed beyond the predetermined angle, the automobile can be driven to a desired safe position even in the event of a failure of the electric motor actuator mechanism. Greater safety is also achieved as the automobile is prevented from running at speeds higher than a certain speed.

Unlike the throttle valve control apparatus 10, 100, 200, the accelerator drum 306 and the intermediate lever 316 are mounted on the accelerator pedal sensor body 224, and the valve shaft lever 204 having the first engaging finger 208 and the lost-motion lever 212 having the second engaging finger 214 are disposed coaxially with the valve shaft 18. The parts of the throttle valve control apparatus 300 may be positioned in any of various combinations of locations, suffer reduced limitations on their positions, and can be designed with increased layout freedom.

Although certain preferred embodiments of the present invention has been shown and described in detail, it should be understood that various changes and modifications may be made therein without departing from the scope of the appended claims.

What is claimed is:

1. A throttle valve control apparatus comprising:

a throttle valve housing;

a valve shaft angularly movably mounted in said throttle valve housing;

a throttle valve mounted on said valve shaft;

an electric motor having a rotatable shaft coupled to an end of said valve shaft; and an accelerator pedal actuator mechanism coupled to an opposite end of said valve shaft and operable by an accelerator pedal, said electric motor being energizable depending on an amount of depression of said accelerator pedal for angularly moving said valve shaft to operate said throttle valve;

said accelerator pedal actuator mechanism comprising:

a first engaging finger angularly movable in response to angular movement of said valve shaft;

a return spring acting on said valve shaft for normally biasing said valve shaft to turn in a valve closing direction to close said throttle valve;

an accelerator drum angularly movable relatively to said valve shaft for angular movement depending on the amount of depression of said accelerator pedal;

a second engaging finger angularly movable in response to angular movement of said accelerator drum; and a lost-motion spring having an end engaging said second engaging finger for normally biasing said second engaging finger in said valve closing direction and an opposite end engaging at least one of said first engaging finger and said second engaging finger for normally biasing said first engaging finger and said second engaging finger or said first engaging finger or said second engaging finger in a valve opening direction to open said throttle valve;

the arrangement being such that when said valve shaft is to be angularly moved by said electric motor, said opposite end of said lost-motion spring engages at least one of said first engaging finger and said second engaging finger to be able to turn said accelerator drum relatively to said valve shaft, and when said valve shaft is to be angularly moved by said accelerator pedal actuator mechanism, said opposite end of said lost-motion spring engages both said first engaging finger and said second engaging finger to turn said accelerator drum and said shaft in unison with each other.

2. A throttle valve control apparatus comprising:

a throttle valve housing;

a valve shaft angularly movably mounted in said throttle valve housing;

a throttle valve mounted on said valve shaft;

an electric motor having a rotatable shaft coupled to an end of said valve shaft; and an accelerator pedal actuator mechanism coupled to an opposite end of said valve shaft and operable by an accelerator pedal, said electric motor being energizable for angularly moving said valve shaft and opening said throttle valve a predetermined angle depending on an amount of depression of said accelerator pedal;

said accelerator pedal actuator mechanism comprising:

a first engaging finger angularly movable in response to angular movement of said valve shaft;

a return spring acting on said valve shaft for normally biasing said valve shaft to turn in a valve closing direction to close said throttle valve;

an accelerator drum angularly movable relatively to said valve shaft for angular movement depending on the amount of depression of said accelerator pedal;

a second engaging finger angularly movable in response to angular movement of said accelerator drum; and a lost-motion spring having an end engaging said second engaging finger for normally biasing said second engaging finger in said valve closing direction and an opposite end capable of engagement with both of said first engaging finger and said second engaging finger for biasing one or both of said first engaging finger and said second engaging finger in a valve opening direction to open said throttle valve;

the arrangement being such that when said valve shaft is angularly moved by said electric motor, said opposite end of said lost-motion spring engages at least one of said first engaging finger and said second engaging finger to turn said accelerator drum relatively to said valve shaft, and when said valve shaft is angularly moved by said accelerator pedal actuator mechanism, said opposite end of said lost-motion spring engages both said first engaging finger and said second engaging finger to turn said accelerator drum and said shaft in unison with each other.

3. A throttle valve control apparatus according to claim 2, wherein said first engaging finger and said second engaging finger are angularly movable along respective arcuate paths having different radii of curvature, in said valve opening direction and said valve closing direction out of interfering engagement with each other.

4. A throttle valve control apparatus according to claim 2, wherein said first engaging finger is angularly movable along an arcuate path having a first radius of curvature, and said second engaging finger is angularly movable along an arcuate path having a second radius of curvature, said first radius of curvature being smaller than said second radius of curvature.

5. A throttle valve control apparatus according to claim 2, wherein said accelerator pedal actuator mechanism comprises:

a valve shaft lever fixed to said valve shaft;

an accelerator pedal sensor body mounted on said throttle valve housing;

an accelerator pedal sensor return spring for normally biasing said accelerator drum angularly movably mounted on said accelerator pedal sensor body to turn in the valve closing direction;

an accelerator wire engaging mechanism interconnecting said accelerator drum and said accelerator pedal;

an intermediate lever disposed between said accelerator pedal sensor body and said accelerator drum and having said first engaging finger; and a link operatively interconnecting said intermediate lever and said valve shaft lever for angular movement in unison with each other;

said return spring engaging said throttle valve housing and said valve shaft lever for normally biasing said throttle valve in the valve closing direction, said accelerator drum having said second engaging member, said lost-motion spring being disposed between said intermediate lever and said accelerator drum.

6. A throttle valve control apparatus according to claim 2, wherein said accelerator pedal actuator mechanism comprises:

a valve shaft lever fixed to said valve shaft and having said first engaging finger;

an accelerator wire engaging mechanism interconnecting said accelerator drum and said accelerator pedal;

an accelerator pedal sensor body fixed to said throttle valve housing;

an accelerator pedal sensor lever angularly movably mounted on said accelerator pedal sensor body;

an accelerator pedal sensor return spring for normally biasing said accelerator pedal sensor lever to turn in the valve closing direction; and a link operatively interconnecting said accelerator drum and said accelerator pedal sensor lever for angular movement in unison with each other;

said return spring engaging said throttle valve housing and said valve shaft lever for normally biasing said throttle valve in the valve closing direction, said accelerator drum being disposed coaxially with and angularly movably relatively to said valve shaft, said accelerator drum having said second engaging member, said lost-motion spring being disposed between said valve shaft lever and said accelerator drum.

7. A throttle valve control apparatus according to claim 6, wherein said valve shaft lever and said accelerator drum are disposed coaxially with said valve shaft.

8. A throttle valve control apparatus according to claim 2, wherein said accelerator pedal actuator mechanism comprises:

a valve shaft lever fixed to said valve shaft and having said first engaging finger;

a lost-motion lever disposed coaxially with and angularly movably relatively to said valve shaft, said lost-motion lever having said second engaging finger;

an accelerator pedal sensor body fixed to said throttle valve housing;

an accelerator pedal sensor return spring for normally biasing said accelerator drum angularly movably mounted on said accelerator pedal sensor body to turn in the valve closing direction; and a link operatively interconnecting said lost-motion lever and said accelerator drum for angular movement in unison with each other;

said return spring engaging said valve shaft lever and said throttle valve housing for normally biasing said throttle valve in the valve closing direction, said lost-motion spring being disposed between said valve shaft lever and said lost-motion lever.

9. A throttle valve control apparatus according to claim 8, wherein said valve shaft lever and said lost-motion lever are disposed coaxially with said valve shaft, and said accelerator drum is angularly movably mounted on said accelerator pedal sensor body.

10. A throttle valve control apparatus according to claim 2, wherein said accelerator pedal actuator mechanism comprises:

a valve shaft lever fixed to said valve shaft and having said first engaging finger;

a lost-motion lever disposed coaxially with and angularly movably relatively to said valve shaft, said lost-motion lever having said second engaging finger;

an accelerator pedal sensor body fixed to said throttle valve housing;

an accelerator wire engaging mechanism interconnecting said accelerator drum angularly movably mounted on said accelerator pedal sensor body and said accelerator pedal;

an accelerator pedal sensor return spring for normally biasing said accelerator drum to turn in the valve closing direction;

an intermediate lever disposed between said accelerator pedal sensor body and said accelerator drum coaxially with said accelerator drum; and a link operatively interconnecting said intermediate lever and said lost-motion lever for angular movement in unison with each other;

said return spring engaging said valve shaft lever and said throttle valve housing for normally biasing said throttle valve in the valve closing direction, said lost-motion spring being disposed between said valve shaft lever and said lost-motion lever, the arrangement being such that when said accelerator drum is angularly moved a predetermined angle, said intermediate lever is angularly moved in unison with said accelerator drum.

11. A throttle valve control apparatus according to claim 10, wherein said valve shaft lever and said lost-motion lever are disposed coaxially with said valve shaft, and said accelerator drum and said intermediate lever is angularly movably mounted on said accelerator pedal sensor body.

12. A throttle valve control apparatus according to claim 2, wherein said throttle valve control apparatus is mounted in an automobile.

* * * * *